United States Patent [19]

Molin

[11] Patent Number: 4,499,953

[45] Date of Patent: Feb. 19, 1985

[54] APPARATUS FOR DRILLING ROCK

[75] Inventor: Alexis Molin, Saltsjöbaden, Sweden

[73] Assignee: Atlas Copco Aktiebolag, Nacka, Sweden

[21] Appl. No.: 540,097

[22] Filed: Oct. 7, 1983

Related U.S. Application Data

[63] Continuation of Ser. No. 304,984, Sep. 23, 1981, abandoned, which is a continuation of Ser. No. 916,492, Jun. 19, 1978, abandoned.

[30] Foreign Application Priority Data

Jun. 21, 1977 [SE] Sweden ..... 7707139-7

[51] Int. Cl.[3] ..... E21B 15/04

[52] U.S. Cl. ..... 173/43; 173/38; 173/44; 182/2

[58] Field of Search ..... 173/2, 20, 38, 42, 43, 173/44, 4; 182/2; 137/625.22, 625.23, 625.3; 248/188.3; 91/419

[56] References Cited

U.S. PATENT DOCUMENTS

| | | | |
|---|---|---|---|
| 3,171,437 | 3/1965 | Suechting | 137/625.23 X |
| 3,481,409 | 12/1969 | Westerlund | 173/43 |
| 3,721,304 | 3/1973 | Hanson | 173/43 X |
| 3,724,559 | 4/1973 | Stromnes | 173/38 X |
| 3,893,540 | 7/1975 | Beucher | 182/2 |
| 4,066,135 | 1/1978 | Wallace | 173/44 |

FOREIGN PATENT DOCUMENTS 1083476 1/1955 France .

*Primary Examiner*—Robert P. Olszewski

*Attorney, Agent, or Firm*—Frishauf, Holtz, Goodman & Woodward

[57] ABSTRACT

A rock drilling machine is swingably carried on a pivotable drill boom. The rock drilling machine is fed along a drilling axis in response to a feeding movement applied by the drill boom. A set angle value is fed to a servo control system. During drilling, an actual angle value in the form of the angular position in space of the rock drilling machine is fed to the servo control system. The servo control system governs continuously a positioning motor which positions the rock drilling machine relative to the drill boom in such a way that the actual and set values coincide, thereby causing the rock drilling machine to follow the drilling axis.

11 Claims, 22 Drawing Figures

Fig. 19
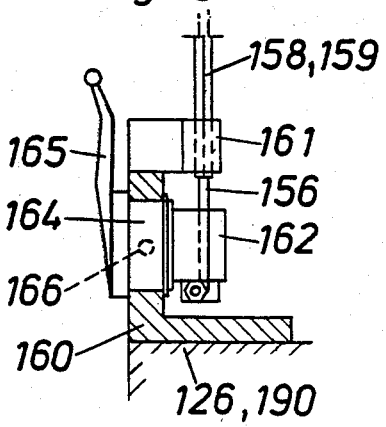
Fig. 18
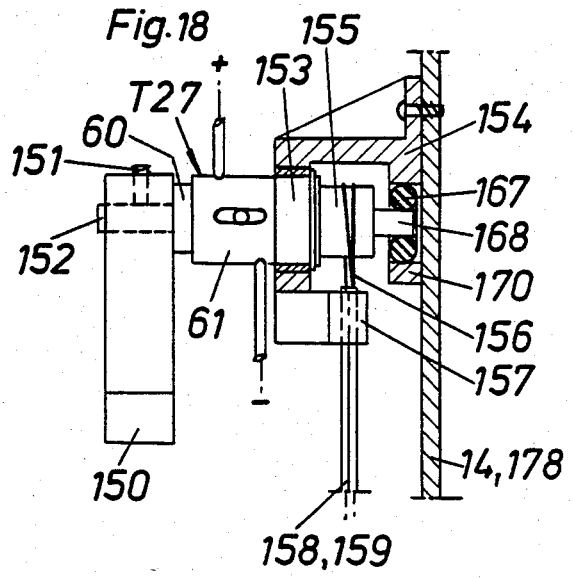
Fig. 20
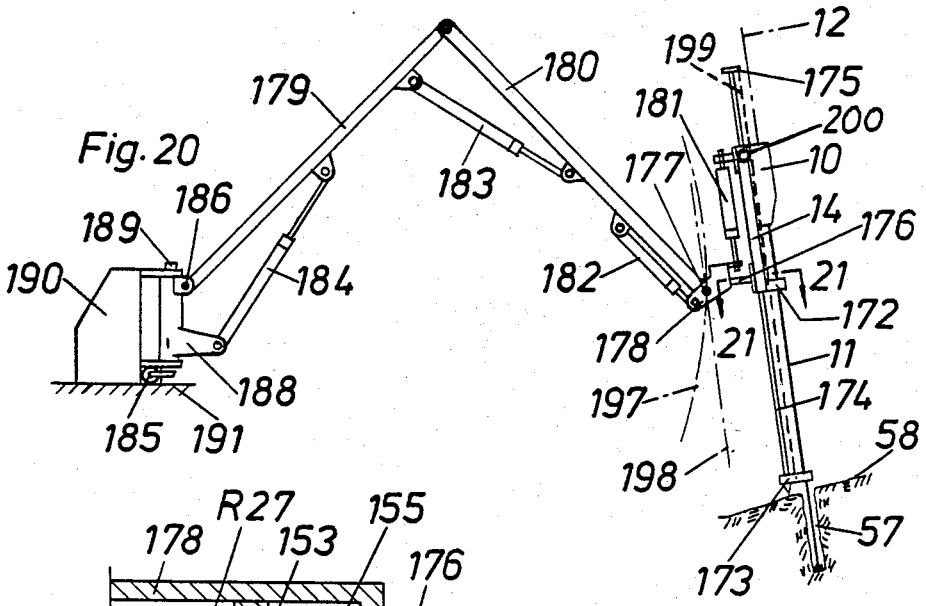
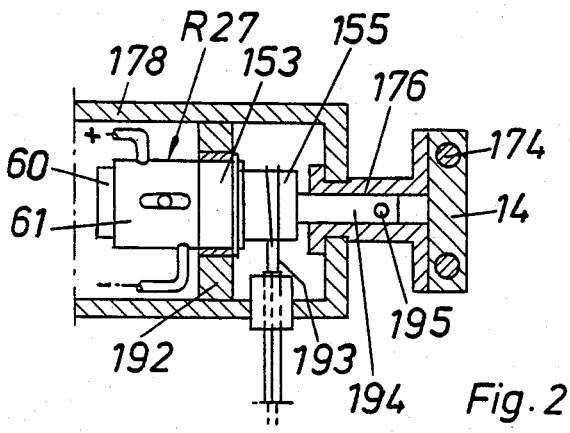
Fig. 21

APPARATUS FOR DRILLING ROCK

This application is a continuation of application Ser. No. 304,984, filed Sept. 23, 1981, which in turn is a continuation of Ser. No. 916,492 filed June 19, 1978 now abandoned.

BACKGROUND OF THE INVENTION

This invention relates to a device for rock drilling comprising a drill boom, a boom bracket for supporting the drill boom, a rock drilling machine carried swingably with respect to the drill boom and the boom bracket and equipped with a drill steel, a pressure fluid actuated adjusting motor means connected to the drill boom for positioning the rock drilling machine relative to the drill boom, and a servo system which controls the adjusting motor means during drilling in such a way that the rock drilling machine is fed along a desired drilling axis as a consequence of a feed movement applied by the drill boom.

In previously disclosed devices of this type (Swedish Pat. No. 343,104), corresponding to U.S. Pat. No. 3,724,559 the use of the servo system has caused function trouble due to the complexity of its construction.

The object of the present invention is to considerably simplify the control method and the construction of the control system in order to achieve a more reliable function in extremely light self-drilling drilling equipment. This object is attained by the characterizing features in the claims following hereinafter.

BRIEF DESCRIPTION OF THE DRAWINGS

In FIG. 11, the central shaft member is turned in order to illustrate the mechanical relationship between the details in these figures.

FIG. 18 shows partly in vertical section an alternative adjustment of the directional control valve in the invention which adjustment is related to the vertical line.

FIG. 19 shows a view of the adjusting means of the directional control valve corresponding to the view thereof in FIG. 18.

FIG. 20 shows a side view of a foldable boom in which the invention is applied.

FIG. 21 is an enlarged section taken along line 21—21 in FIG. 20.

DETAILED DESCRIPTION

Figure 1:
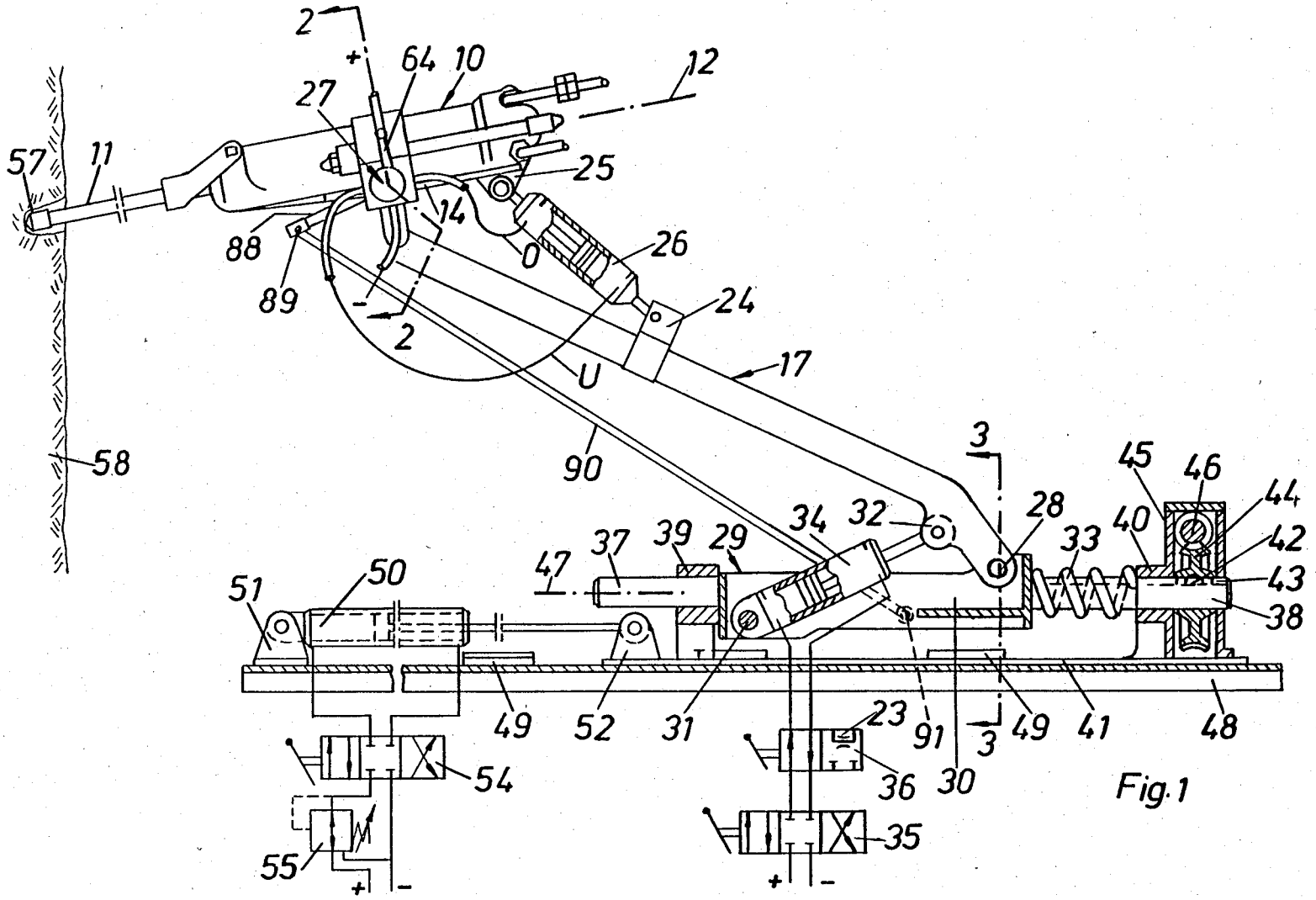
FIG. 1 shows an arrangement in drill booms according to the invention, partly in longitudinal section, and having diagrammatical valve symbols.

A conventional light pneumatically or hydraulically powered rock drilling machine 10, preferably percussive, carries a drill steel 11 along an imaginary drilling axis 12. An adjusting shaft 13, FIG. 2, carries freely turnably the rock drilling machine 10 at the support 14 thereof. The adjusting shaft 13 is also received turnably in a couple of journalling lugs 15 on a yoke 16 at the outer portion of a drill boom 17. A positioning motor or control cylinder 26 is pivotally coupled across the adjusting shaft 13 between a bracket 24 on the drill boom 17 and a bracket 25 on the support 14 of the rock drilling machine. The length of the cylinder 26 is adjusted by means of a directional control valve 27 which is connected through the conduits O and U to the upper chamber and lower chamber, respectively, of the control cylinder 26. By adjusting the length of the cylinder 26, the rock drilling machine 10 and its drilling axis 12 are angularly adjustable in a swinging plane which coincides with the central plane of the drill boom 17.

The drill boom 17 is swingably journalled by means of a pivot 28 in a frame 30 on a boom support 29. A power cylinder 34 is pivotally coupled between a pivot 31 in the frame 30 and a bracket 32 on the drill boom 17. The length of the cylinder 34 is adjusted by means of a directional control valve 35 in order to angularly adjust the drill boom 17 about the pivot 28 with respect to the boom support 29. A release valve 36 is inserted between the directional control valve 35 and the cylinder 34. Upon actuation of the release valve 36, the adjusting action of the cylinder 34 ceases due to the fact that its opposed cylinder chambers are interconnected, as symbolically shown in FIG. 1. The drill boom 17, then, is freely swingable about the pivot 28. In its active position, the release valve 36 can be provided with a restriction 23 which prevents a too rapid fluid flow between the chambers of the cylinder 34.

In the central plane of the frame 30 and the drill boom 17, the frame 30 carries two pivots 37, 38 which project coaxially in opposite directions. The pivots 37, 38 are journalled turnably and longitudinally displaceably in a pair of bearings 39, 40 which are fixed on a feed slide 41 at a distance from each other. A thrust spring 33 is inserted between the bearing 40 and the frame 30 to bias the frame 30 against the bearing 39. The pivot 38 projects axially slidably into a worm gear 44 and is provided with an axial wedge groove 43. The wedge groove 43 receives slidably a wedge 42 which prevents the worm gear 44 from rotating about the pivot 38. The worm gear 44 is enclosed by a journal housing 45 which is connected to the bearing 40. A warm shaft 46 is rotatably journalled in the journal housing 45 and meshes with the worm gear 44, preferably self-braking. When the worm shaft 46 is rotated in the housing 45 by means of a fluid motor or a cranked handle, not shown, the boom support 29, thus, is angularly adjustable on the slide 41 by means of the worm gear 44 and the pivot 38 about a turning axis 47 which is defined by the bearings 39, 40 and the pivots 37, 38. The common swinging plane of the rock drilling machine 10 and the drill boom 17 is thus optionally angularly adjustable about the shaft 47 with respect to the slide 41.

In the illustrated embodiment, the slide 41 is made in the form of an elongate rectangular plate which is slidably guided along a feed beam 48 between opposed guides 49. The slide 41 is mechanically fed to and fro along the feed beam 48 by means of a suitable conventional feed motor for rock drilling machines. In the illustrated embodiment, a power cylinder feed is diagrammatically shown wherein a feed cylinder 50 is pivotally coupled between a distal bracket 51 on the feed beam 48 and a bracket 52 on the slide 41. The feed direction is set by means of a directional control valve 54 and the feed pressure is set by means of an adjustable pressure reducing valve 55 of suitable conventional type.

Figure 4:
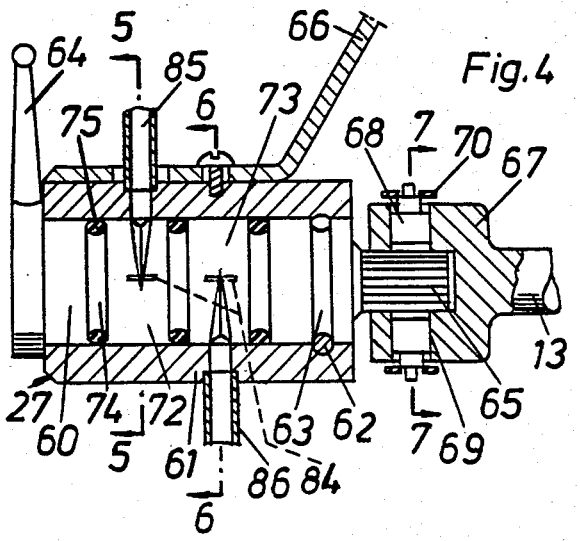
FIG. 4 is an enlarged longitudinal section through the valve in FIG. 2.
Figure 7:
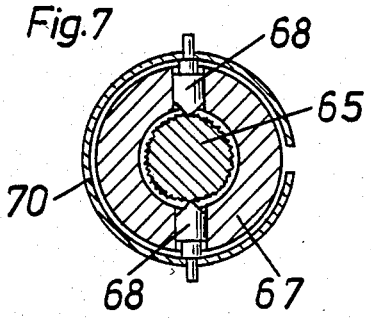
FIG. 7 is an enlarged section taken along line 7—7 in FIG. 4.
Figure 2:
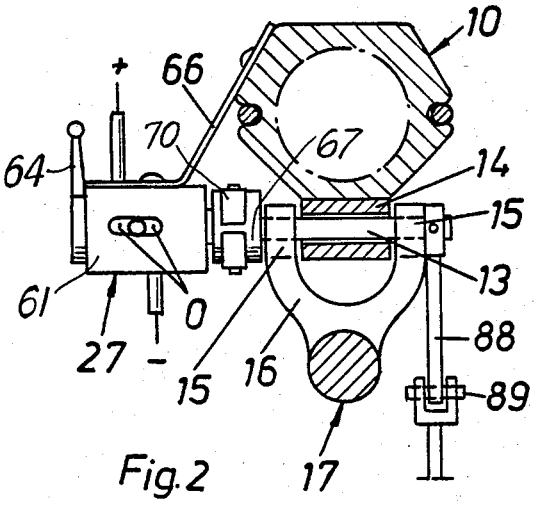
FIGS. 2 and 3 are sections taken along lines 2—2 and 3—3, respectively, as shown in FIG. 1*a*, and in FIG. 1.

The directional control valve 27, FIGS. 2 and 4, which controls adjustment of the length of cylinder 26, comprises a valve slide 60 (FIG. 4) which is rotatably tight-fitting in a valve housing 61. The valve slide 60 is axially fixed by means of a cross pin 62 which is received in an annular groove 63 in the slide 60. An operating lever 64 is mounted on the outer side of the slide 60 and the opposite side of the slide carries a fine-toothed end stud 65. A mounting plate 66 fixes the valve housing 61 to the rock drilling machine 10 coaxially with the adjusting shaft 13. The fine-toothed end stud 65 is received freely rotatably in an adjusting sleeve 67 at the end of the adjusting shaft 13 outside the yoke 16 of the drill boom 17. A couple of sharp-nosed snap pistons 68 extend in radial holes 69 which traverse the adjusting sleeve 67 and are biased against the teeth of the end stud 65, form-fittingly with the teeth but yieldingly. When the slide valve 60 is turned by means of the lever 64 relative to the adjusting shaft 13, the pistons 68 snap over the intermediate teeth of the end stud 65, whereupon they retain the newly adjusted angular position relative to the adjusting shaft 13.

Figure 5:
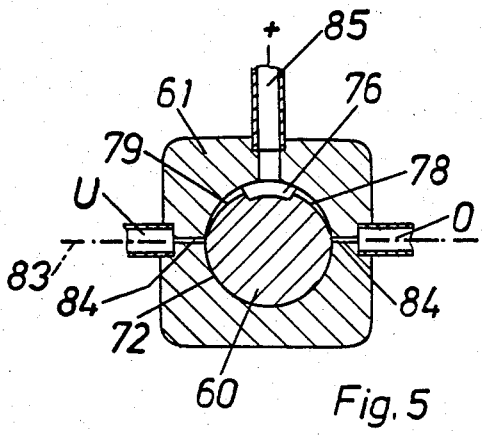
FIGS. 5 and 6 are sections taken along lines 5—5 and 6—6, respectively in FIG. 4.
Figure 6:
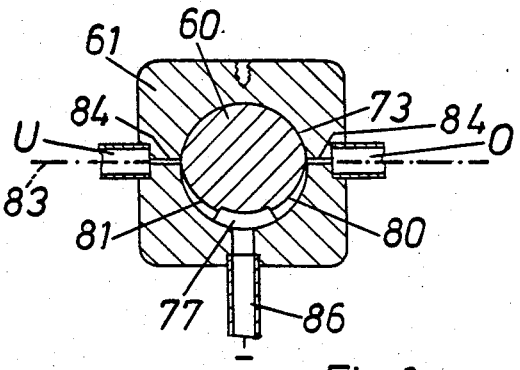

The slide valve 60 is provided with two cylindrical lands 72, 73 which are confined axially by annular grooves 74 having o-rings 75 inserted therein which fit tightly against the valve housing 61. Referring to FIGS. 5 and 6, the lands 72,73 are provided with central grooves 76,77 which are mirror images of each other. Peripheral grooves respectively 78,79 (FIG. 5) and 80,81 (FIG. 6) extend from the central grooves 76,77 in opposite moving directions of the slide-valve 60. The grooves 78–81 have gradually decreasing cross sectional area and/or depth, e.g. by having wedge-point form as illustrated in FIGS. 5 and 6. The grooves 78–81 extend in pairs and mirror symmetrically with respect to a common central plane 83 to a pair of narrow axial slits 84 which in pairs are connected to the lands 72,73 from opposite directions. On one side of the valve housing 61 each of the slits 84 terminates into an own end branch of the conduit O which is connected to the upper chamber of the control cylinder 26. On the other side of the valve housing the slits 84 are in a corresponding way through the conduit U connected to the lower chamber of the control cylinder 26. Pressure fluid (pressure oil or compressed air) is supplied to the central groove 76 through a conduit 85, and the central groove 77 is connected to a discharge conduit 86. The slits 84 can, as in the illustrated embodiment, coincide with the central plane 83 or they can be located in pairs and mirror symmetrically on both sides of the central plane 83. The central plane 83 is suitably adjusted parallel with the drilling axis 12 when the valve housing 61 is set in its fixed position and the lever 64 is suitably perpendicular to the central plane.

Figure 3:
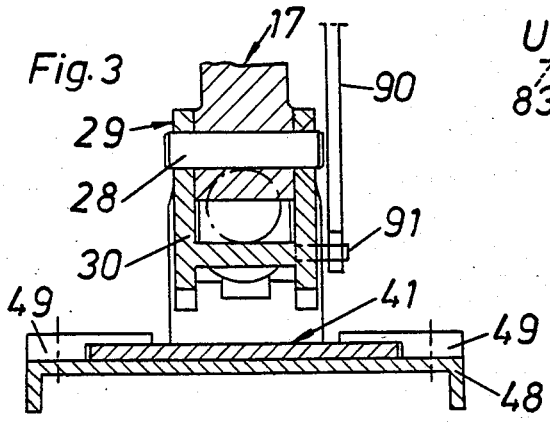

Referring to FIGS. 2 and 3, the adjusting shaft 13 carries non-turnably an arm 88 at the other side of the boom yoke 16. The arm 88 is pivotally connected to a stud 91 on the frame 30 of the boom support 29 via a link pin 89 and a link 90. The central line of the slide valve 60 and the shafts 89, 91 and 28 form the corners in a link parallelogram. During swinging of the boom 17, the adjusting shaft 13 will thus always maintain its angular position and is thus parallel displaced together with the slide valve 60 which is coupled to the shaft 13 over the snap pistons 68.

In FIGS. 5 and 6, the slide valve 60 of the directional control valve 27 is in a symmetrical feed-back coupling position. By means of the restriction grooves 78,79 the pressurized central groove 76 is maintained closed or highly restricted relative to the conduits O and U, i.e. the upper and lower chambers of the control cylinder 26. The low pressure central groove 77 in FIG. 6 is in the same way closed or highly restricted relative to the conduits O and U, i.e. the upper and lower chambers of the control cylinder. In order to increase the adjusting sensitivity in the feed-back coupling position, the leakage flow from the grooves 78,79 in FIG. 5 can be chosen larger than the leakage flow which discharges through the grooves 80, 81 in FIG. 6, which means that the two chambers of the control cylinder 26 are maintained under pressure. When the slide valve 60 is turned in the clock-wise direction in FIGS. 5 and 6, the pressurized central groove 76 is connected to the conduit O in FIG. 5 through the groove 78, and the valve land 72 in the same figure maintains the conduit U closed. At the same time, the low pressure groove 77 in FIG. 6 is connected to the conduit U through the groove 81 and the valve land 73 maintains the conduit O closed with respect to the discharge outlet 86. This means that the upper chamber O of the control cylinder 26 is pressurized and that its lower chamber U at the same time is connected to tank, thereby contracting the control cylinder 26. Upon a counter clock-wise turning of valve 60 in FIGS. 5 and 6, the directional control valve 27 causes in similar manner an extension of the control cylinder 26 via the restriction grooves 79, 80. Due to the fact that the valve housing 61 over the plate 66 is fixed to the rock drilling machine 10 co-turnably therewith and thus defines the actual angular value of the rock drilling machine, a change in length of the control cylinder 26 also causes a turning of the valve housing 61. In case of a clock-wise turning of valve 60, when the control cylinder 26 is contracted, the rock drilling machine 10 is thus swung and thereby the valve housing 61 is also turned clock-wise until its symmetry or feed-back coupling position with respect to the central plane 83 is taken back in the newly adjusted angular position of the slide valve 60. The directional central valve 27 thus operates as a servo in which a set value angular position is set by means of the slide valve 60, whereupon the control cylinder 26 subsequently will turn the valve housing 61 to cause the valve housing to seek out the feed-back coupling position, and thus a closed or almost closed restricted position of the valve; the valve housing defining the actual value of the angular direction of the rock drilling machine.

In the above, the function of the directional control valve 27 is described when the valve slide 60 is turned relative to the adjusting sleeve 67 and the shaft 13, clock-wise or counter clock-wise, which means that the drilling axis 12 could be angularly adjusted with respect to the drill boom 17. When the drill boom 17 in FIG. 1 is swung about the stud 28 by means of the power cylinder 34, the adjusting shaft 13 together with the slide 60 is, as previously mentioned, parallel displaced with respect to the boom support 29. Since the slide valve 60 maintains its given angular position in space in all swinging positions of the drill boom 17, the control cylinder 26 will—due to the servo function of the directional control valve 27—automatically turn the rock drilling machine 10 about the adjusting shaft 13 during such swinging of the drill boom in such a way that the actual angular direction value which is common to the rock drilling machine and the valve housing 61 will coincide with the set angular direction value which is defined by the slide valve 60. The rock drilling machine 10, thus, is parallel displaced as long as it is allowed to move freely.

The apparatus is connected to suitable pressure fluid and flushing sources. When the apparatus is ready for drilling, and the slide 41 is thus retracted with respect to the rock 58, the desired swinging plane of the rock drilling machine 10 through the geometrical turning axis 47 is adjusted by means of the worm shaft 46; the drill boom 17 being in a lowered position during the adjustment. Then the necessary adjustment of the elevation and turning of the rock drilling machine 10 is carried out by means of the directional control valves 27, 35 and the two power cylinders 26, 34 associated therewith until the desired direction of the drilling axis 12 is attained. During the free swinging of the rock drilling machine 10 by means of the power cylinder 34 and the drill boom 17, the lever 64 will always be directed perpendicular to the drilling axis 12. Therefore, the direction of the drilling axis can easily be determined by measuring the angle of the lever with respect to the vertical line. Upon having started the rock drilling machine 10, the collaring and first penetration of the desired hole 57 in the rock 58 is made by actuating the feed valve 54. When a suitable feed pressure is adjusted by means of the pressure reducing valve 55, the cylinder 34 is released by means of the release valve 36, whereupon the directional control valve 27 automatically directs the rock drilling machine 10 along the drilling axis 12 by extension or contraction of the control cylinder 26 during the continued drilling.

Figure 8:
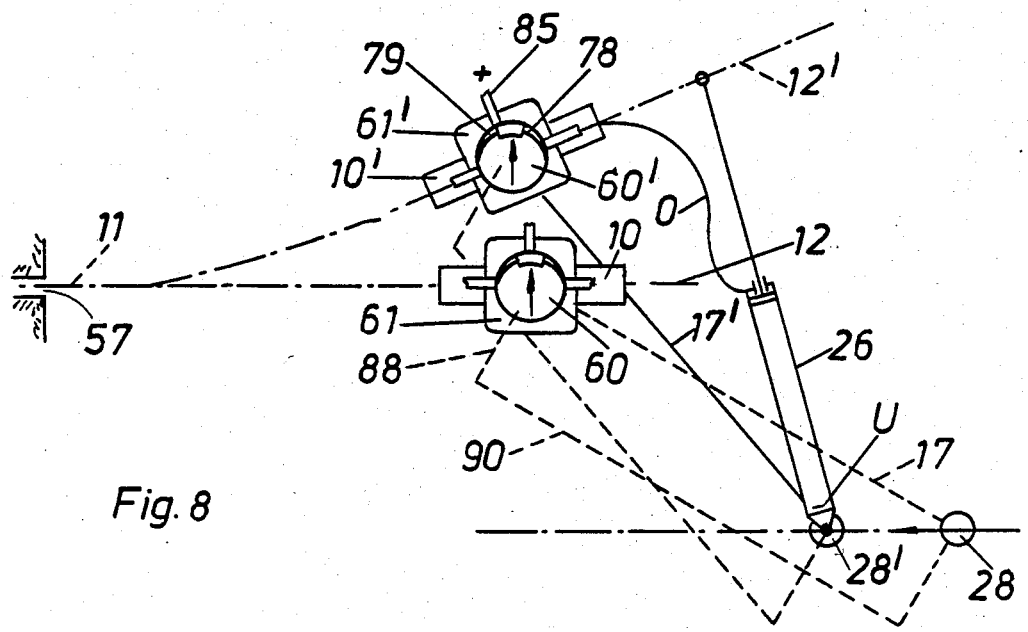
FIG. 8 shows diagrammatically the function of the valve members in FIG. 5 in two alternative positions, primarily relating to FIG. 1.

While drilling is going on, suppose that the drill boom 17 in FIG. 8 is fed from the position shown by broken lines to the upstanding position 17$^1$ shown by continuous lines. During such movement, which occurs when the drilling rate is insufficient and the applied feeding movement preponderates thereover, the stud 28 is moved to position 28$^1$. During this movement, the links 88, 90 of the parallelogram maintain the direction of the valve slide 60 which is parallel displaced from position 60 to position 60$^1$; the movement being highly exaggerated in FIG. 8. Since the front end of the drill steel 11 remains in the hole 57, the rock drilling machine cannot be parallel displaced through the feed-back coupling but has a tendency to turn from position 10 to position 10$^1$ during leakage in the valve slide 60. The valve housing, then, is turned to position 61$^1$. As to the cross section of the valve shown in the figure, the above turning of the valve housing causes pressure fluid from the conduit 85 to be supplied to the upper chamber of the control cylinder 26 through the restriction groove 78 and the conduit O. At the same time, as to the cross section, not shown, of the valve in FIG. 6, the turning of the valve housing causes the lower chamber U of the control cylinder 26 to be connected to tank. Thus, the control cylinder 26 swings the drilling axis 12$^1$ back to the prescribed direction 12. During contraction of the control cylinder 26, the drill steel 11 kicks upwardly against the wall in the hole 57. In FIG. 1, the correction is possible either by rebound of the boom support 29 due to the spring 33, or, alternatively, by allowing the cylinder 50 to take up the rearwardly-directed force on the boom support 29 and the slide 41 by a pressure-adapted change in length by means of the pressure reducing valve 55.

When, instead, the drilling rate becomes predominant over the feed from the cylinder 50, the drill boom 17 has a tendency to be lowered, and the valve housing 61 is lowered relative to the front end of the drill steel 11 remaining in the hole 57. It is obvious that the slide valve 60 now instead will pressurize the lower chamber of the control cylinder 26 through the restriction groove 79 and the conduit U, thereby causing the cylinder 26 to be extended, which causes the drill steel 11 to kick downwardly against the wall of the hole 57. Due to this fact, the rock drilling machine 10 seeks to elevate the forward end of the drill boom 17 and thus correct its direction and affect the feeding course either by extension of the spring 33 or by a restraining force on the drill steel counteracting the drilling rate. When the drilling operation is finished, the feed is reversed by means of the valve 54 and the drill boom is held by means of the cylinder 34 and its directional control valve 35 or by means of the restriction 23 of the release valve 36.

Regarding the accuracy of the adjustment, it is advantageous to use a drill steel 11 which is somewhat oversized so that the drill steel, due to increased stiffness, defines the actual angular value of the rock drilling machine 10 relative to the drill hole at smallest possible deflection. When so needed, as described in the following with reference to FIGS. 20 and 21, one or a pair of guiding rods provided with a drill steel centralizer can be mounted on the rock drilling machine 10 or on its support 14. The guding rods are caused to rest against the rock adjacent the hole so that a rigid angle transmission to the rock drilling machine is attained.

Figure 1A:
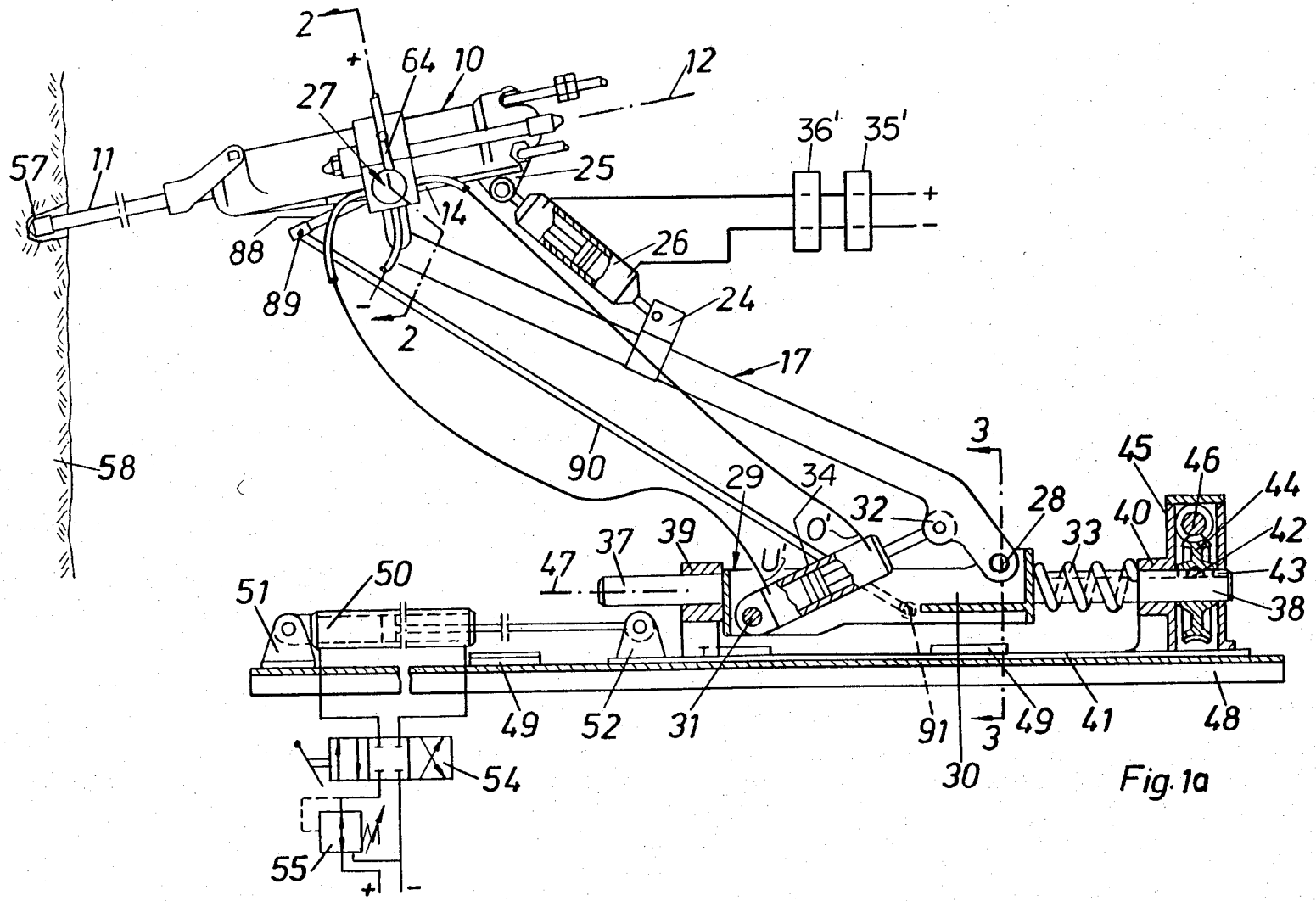
FIG. 1*a* shows a modification of the embodiment of FIG. 1.

Alternatively, as shown in FIG. 1*a* the power cylinder 34 between the drill boom 17 and its supporting device, in this case the boom support 29, can be a control cylinder. In doing so, the directional control valve 27 in FIG. 1 is instead connected to conduits O$^1$ and U$^1$ in the cylinder 34, and the power cylinder 26 is associated with a release valve 36$^1$ and a directional control valve 35$^1$ of the same type as shown in FIG. 1 for the power cylinder 34. After positioning, collaring and applied feeding force by the cylinder 50, the cylinder 26 is released by means of the release valve 36$^1$ and the direction of the rock drilling machine 10 is adjusted and controlled by means of the constant pressure cylinder 50 and the power cylinder 34 which now operates as control cylinder. By extension or contraction of the cylinder 34, the front end of the drill boom 17 is elevated or lowered, and the rock drilling machine 10 is thus swingably adjusted relative to the front end of the drill steel 11 which is coaxially supported in the hole 57 so that the drilling axis 12 remains unchanged.

Figure 12:
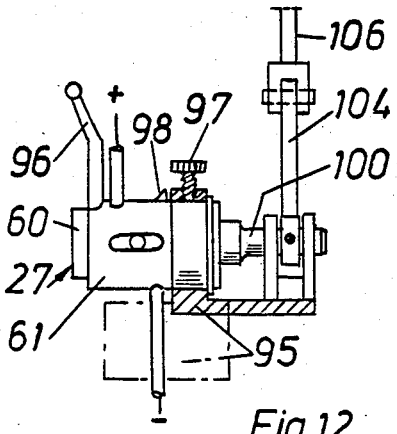

In the embodiment according to FIGS. 9–12, the directional control valve 27 and its housing 61 are rotatably journalled in a bracket 95, FIG. 12, which is fixedly connected to the pivot 37 of the boom support 29. The housing 61 carries a lever 96 and can be rotatably adjusted in the bracket 95 and locked by means of an adjusting screw 97. A pointer 98 on the housing 61 cooperates with a scale, not shown, on the bracket 95. The scale is divided into degrees and indicates the slope of the drilling axis 12. In comparison with FIG. 1, the connections are reversed in the valve housing 61 of the conduits O and U leading to the upper and lower chambers of the cylinder 26. The set value of the drilling axis 12 is set by means of the lever 96. The actual value of the rock drilling machine 10 is parallel displaced based on parallelograms from the adjusting shaft 13 to an intermediate shaft 99 and from the intermediate shaft to a shaft member 100, which is non-rotatably connected to the slide valve 60. The adjusting shaft 13 is non-turnably connected to the support 14 of the rock drilling machine 10. The two parallelograms comprise four link arms 101–104; the link arm 101 being non-turnably connected to the adjusting shaft 13, the link arms 102, 103 in the same manner being connected to opposite ends of the intermediate shaft 99, and the link arm 104 being non-turnably connected to the slide valve 60 over the shaft member 100. The intermediate shaft 99 traverses a bore, freshly rotatably therein, in the pivot 28 of the drill boom 17. A link 105 is pivotally connected to the link arms 101, 102 and has the same length as the distance of the drill boom 17 between the adjusting shaft 13 and the intermediate shaft 99. The members 101, 102, and 105 form a first parallelogram. The second parallelogram is formed by the link arms 104, 103 and a link 106 pivotally connected thereto. The link 106 has the same length as the distance between the intermediate shaft 99 and the shaft member 100 (FIG. 12) on the slide valve 60. These two parallelograms transfer the actual angular direction of the rock drilling machine 10 to the slide valve 60 in all adjusted positions of the drill boom 17.

Figure 9:
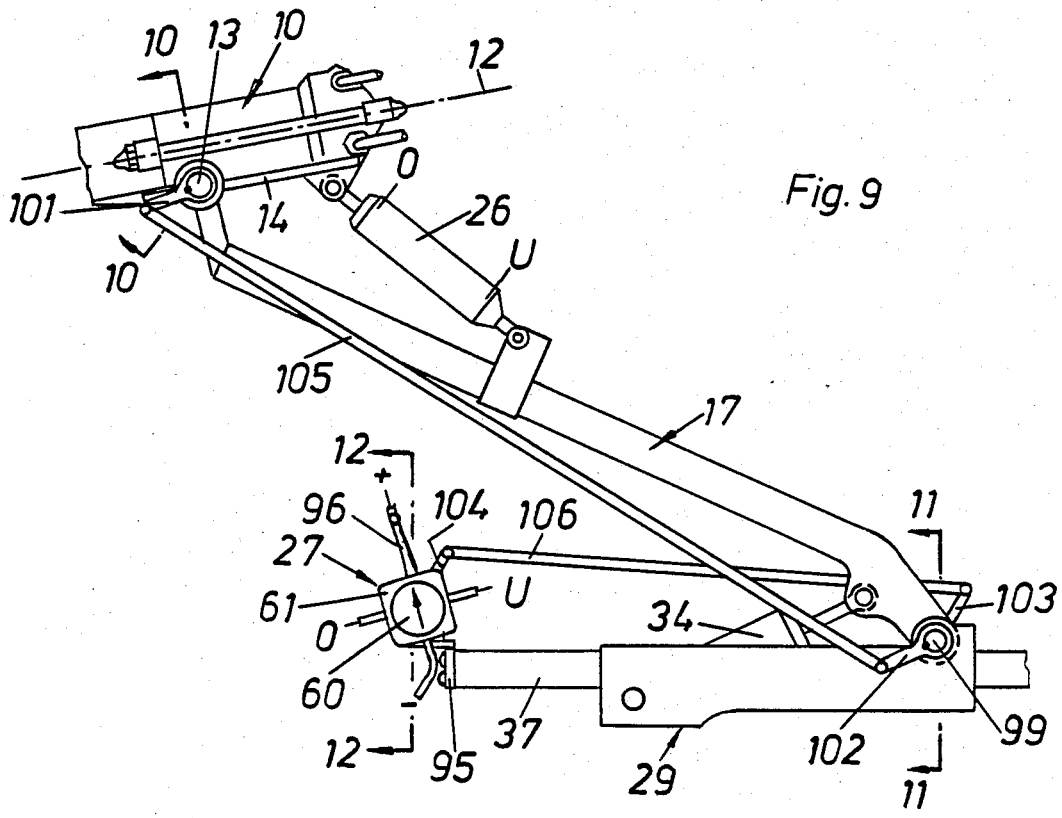
FIG. 9 shows a partial view corresponding to FIG. 1 of a device having a modified valve arrangement.
Figure 10:
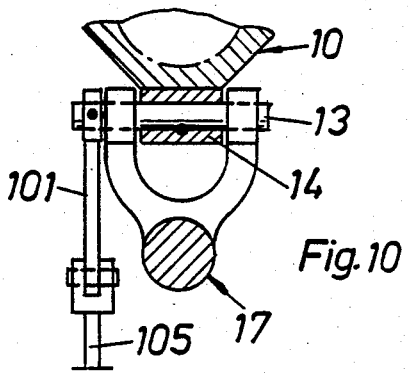
FIGS. 10, 11 and 12 are fragmentary sections taken along lines 10—10, 11—11 and 12—12 in FIG. 9.
Figure 13:
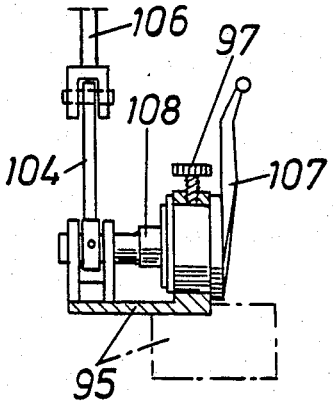
FIG. 13 shows a modification of the device in FIG. 12.

If, in conformity with FIGS. 1 and 2, it is preferred to mount the directional control valve 27 at the rock drilling machine 10, a linkage system similar to that shown in FIG. 9 can be utilized to remote control set the angular set value of the slide valve 60 from a shaft 108 on the bracket 95, FIG. 13. The valve 27 in FIG. 12, thus, is moved and replaced in FIG. 13 by an operating lever 107 which is directly connected to the shaft member 100. The adjusted swinging position of the lever 107, and thus the position of the arm 104 of the parallelogram, can be fixed for example by locking an enlarged portion 108 of the shaft member by means of the adjusting screw 97.

Figure 14:
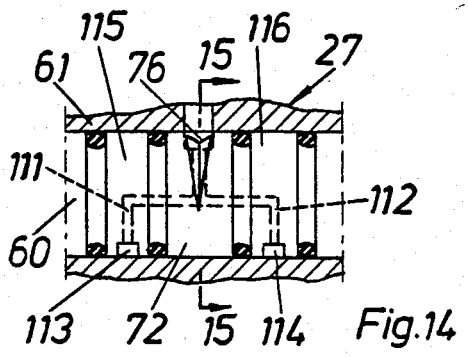
FIG. 14 is a partial section through a pressure balanced modification of the directional control valve in FIGS. 4–6.
Figure 11:
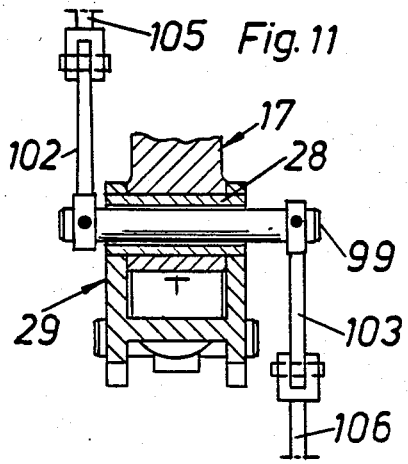
Figure 15:
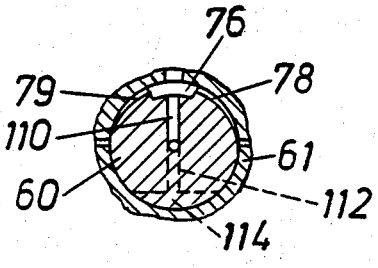
FIG. 15 is a section taken along line 15—15 in FIG. 14.

In order to facilitate rotation of the slide valve 60 in the housing 61 of the directional control valve 27, balancing by means of the active pressure fluid can be provided, FIGS. 14 and 15. A passage 110 leads from the centre groove 76 in the slide valve 60. The passage 110 is through its branches 111, 112 connected to a pair of grooves 113, 114 which are diametrically opposed to the groove 76. The pressure area of the grooves 113, 114 are chosen large enough to balance the slide valve 60 with respect to the pressure which acts in the central groove 76 and the restriction grooves 78,79 when the slide valve 60 tightly fits in the housing 61. The balancing grooves 113, 114 are symmetrical with respect to the transverse plane through the grooves 76,78,79 and are each located in a land 115, 116 on separate sides of the land 72. An analogous balancing can be applied on the discharge central groove 77 of the slide valve and its restriction grooves 80, 81.

The angular accuracy which in practice can be attained during adjustment by means of the directional control valve 27 can be increased by making the diameter of the valve larger and the slits 84 narrower. Besides, the slits 84 can be formed as a row of adjacent fine bores in groups. In doing so, somewhat more bores can be provided in connection with each of the grooves 78,79 than in connection with the grooves 80,81 so that the discharge restriction becomes somewhat larger than the restriction of the inlet of the control cylinder. By making the wedge-point form of the grooves 78–81 more blunt-ended it is possible to increase the accuracy and find the feed-back coupling position more rapidly due to a larger difference in the restriction effect counted per minute of arc of the rotation of the valve slide. An alternative embodiment of the directional control valve 27 is also described in Swedish patent application No. 7707138-9, FIGS. 4,13,14, which has been filed in Sweden on June 21, 1977, corresponding to U.S. application Ser. No. 916,063, filed June 16, 1978.

The positioning motor in the invention must not necessarily be a double-acting pressure fluid cylinder but can, when needed, be other types of motors, suitably reversible, which are coupled to allow angular adjustment, e.g. conventional turning cylinders having a meshing helicoidal groove, vane motors and link type motors having a screw transmission or toothed transmission gear etc.

Figure 16:
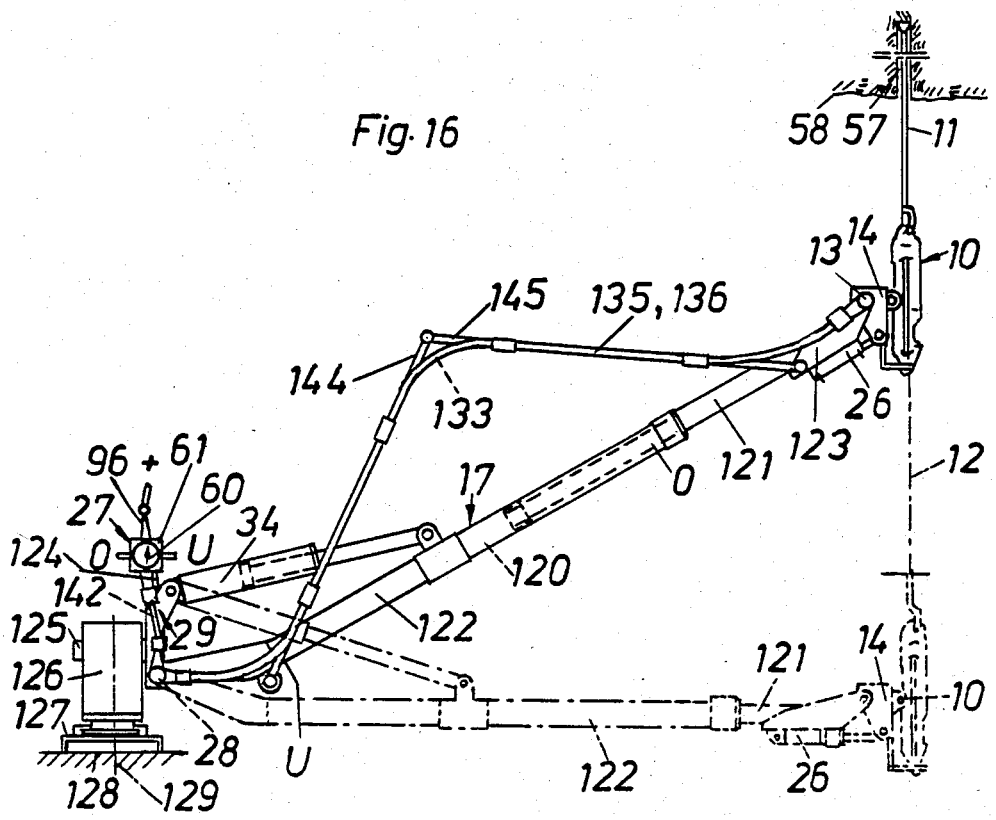
FIG. 16 illustrates the invention applied on a roof bolting apparatus.

In the roof-bolting apparatus in FIG. 16, the support 14 of the rock drilling machine 10 is journalled at the adjusting shaft 13 of the drill boom 17 and the rock drilling machine is directed upwards. The rock drilling machine 10 is angularly adjustable by means of a power cylinder 26 which is coupled between a bracket 123 and the support 14. The drill boom 17 is of the extension-type and is pivotally connected to a shaft 28 on a boom support 29. The cylinder member of a control cylinder 120 forms the fixed member 122 of the extension boom 17. The piston rod of the control cylinder 120 forms the boom extension member 121 which is prevented from rotating relative to the fixed boom member 122, for example by wedges, not shown. The boom extension member 121 carries the bracket 123 on which the adjusting shaft 13 is journalled. The power cylinder 34 is pivotally coupled between the boom support 29 and the fixed boom member 122. In similarity with the embodiment in FIGS. 9 and 12, the boom support 29 carries the directional control valve 27 turnably on a bracket 124. The valve housing 61 is turnably adjustable by means of the lever 96. The conduits U and O leading from the valve 27 are connected to the upper and lower chambers, respectively, of the control cylinder 120.

The boom support 29 is mounted on a horizontal shaft 125 which can be adjusted to a desired turning angle by means of a conventional turning motor, not shown, in a housing 126. The housing 126 can be movable sidewards on a guiding means 127 and be locked relative thereto. Preferably, the guiding means 127 forms part of a drill rig 128, not shown. When so needed, also the housing 126 can be turnably adjustable relative to the guiding means 127 about a vertical axis 129.

Figure 17:
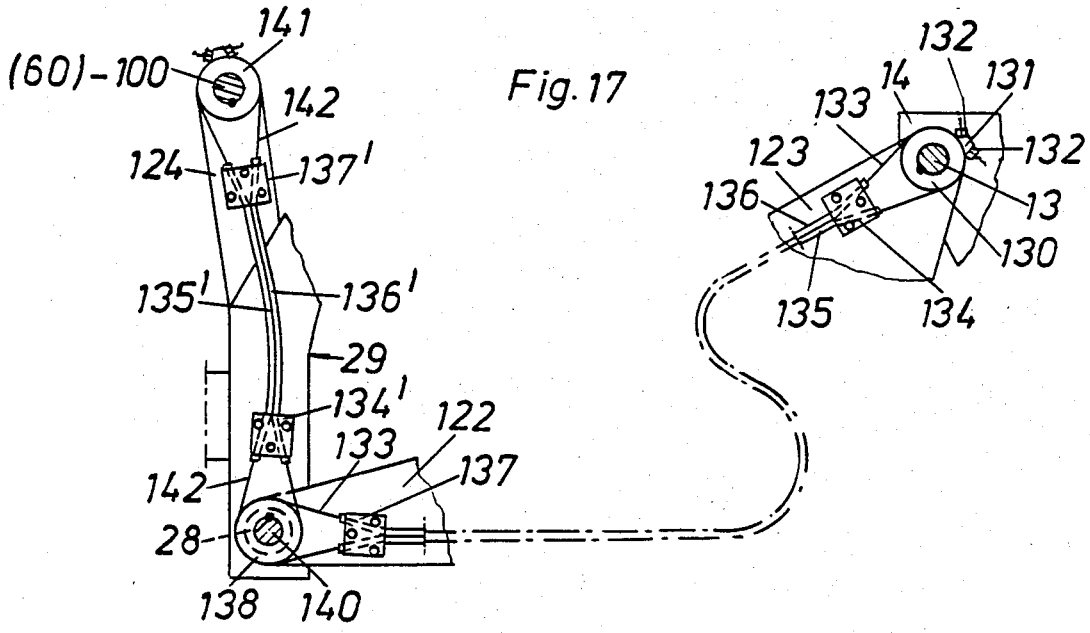
FIG. 17 illustrates diagrammatically on an enlarged scale the parallel displacement of the actual angular valve of the rock drilling machine in FIG. 16.

Instead of the parallel displacement means shown in FIGS. 9–12 which has two link parallelograms, parallel displacement is applied by means of changes in length of the extension boom 17 and by means of two steel wire transmissions 133, 142 of brake cable type. The adjusting shaft 13 and the support 14 are rotatable as a unit. As seen in FIG. 17, the adjusting shaft carries non-rotatably a drum 130 which has a shoulder 131 against which clamping nuts 132 are resting. The ends of a steel wire 133 which forms one of the transmissions are laid on the drum 130 and are provided with bolt ends attached thereto. The bolt ends are inserted through bores in the shoulder 131 from opposite directions, and the clamping nuts 132 are screwed on the bolt ends. By tightening the clamping nuts 132, the two parts of the steel wire 133 can be stretched. Each of the parts of the steel wire is inserted through a flexible guiding tube 135, 136 from a branching fastener 134 to a similar branching fastener 137 which is fixed to the base member 122 of the extension boom 17 straight in front of a drum 138. The branching fastener 134 clamps the guiding tubes 135, 136 to the bracket 123. The parts of the steel wire 133 meet around the drum 138, being wound one or several turns therearound. The drum 138 is non-turnably connected to a shaft 140 which is journalled freely rotatably concentrically with the pivot 28 analogous to the journalling of the shaft 99 in FIG. 11. The steel wire 142 of the second transmission runs from the drum 138 to a drum 141 via similar branching fasteners 134[1], 137[1] and guiding tubes 135[1], 136[1]. The drum 141 is non-turnably fixed to the slide valve 60 of the directional control valve 27 via the shaft member 100 of the slide valve, compare FIG. 12. The actual angular value of the rock drilling machine 10 is transferred to the adjusting shaft 13 via the support 14 and from the adjusting shaft 13 to the slide valve 60 of the directional control valve 27 via the two steel wire transmissions. A pair of mutually pivotally connected toggle joint links 144, 145 is pivotally connected on the one hand to the bracket 123, and on the other to the base member 122. The flexible guiding tubes 135, 136 of the steel wire transmission 133 are moved over the toggle joint links 144, 145 and are fixed thereto so that the parts of the transmission wire are maintained stretched and effectively guided regardless of changes in length of the extension boom 17.

Upon having positioned the rock drilling machine 10 and having made the collaring by means of the power cylinders 34, 26 and 120, the power cylinder 26 is released in the position shown by chain-dotted lines in FIG. 16 by means of a release valve similar to the valve 36 in FIG. 1. Then a suitable feeding pressure in the cylinder 34 is applied by means of a directional control valve and a pressure regulating valve analogous to the valves 54, 55 in FIG. 1, whereupon the valve housing 61 is locked in its adjusted angular position. When the rock drilling machine 10 during drilling and feeding seeks to deflect from the drilling axis 12, for instance because of the feeding upward swinging of the drill boom 17 by means of the power cylinder 34, the angular change relative to the hole 57 of the rock drilling machine 10 is transferred to the slide valve 60 of directional control valve 27 by means of the steel wire transmissions 133, 142. The valve 27, then, adjusts the length of the power cylinder 120, for example by connecting + to U and O to −, in such a way that the boom extension member 121 brings the rock drilling machine 10 back to the drilling axis 12. During drilling, thus, the rock drilling machine 10 is automatically fed along the desired drilling axis 12.

In drill booms wherein the boom, upon positioning, either normally remains in the vertical plane or close thereto, or is swingable to allow positioning of the rock drilling machine in an orthogonal system of coordinates in two planes perpendicular to each other can the above described angle transmissions having links or steel wires and being associated with the boom joints be simplified by setting the tilt angle of the rock drilling machine about the tilt shaft (13 in FIGS. 1 and 16) relative to the vertical line. Such an embodiment is illustrated in FIGS. 18, 19.

A pendulum 150 (FIG. 18) is fixed to a stud 152 by means of a screw 151. The stud 152 projects centrally from the valve slide 60 of the directional control valve T27. The directional control valve T27 is in all essentials made in conformity with the control valve in FIG. 4. The valve housing 61 of the vave T27 is rotatably journalled in a bracket 154 by a machined cylindrical surface 153. The bracket 154 is connected to a free upstanding surface of the support 14 which surface is directed in the longitudinal direction of the drill boom. The valve housing 61 forms a drum 155 inside the bracket 154. The drum 155 is incorporated in a flexible angle transmission having a steel wire 156, a branching fastener 157 on the bracket 154 and guiding tubes 158,159 of the type described in connection with FIG. 17. A friction ring 167 is arranged around a central shaft end 168 for purposes of vibration damping. The shaft end 168 extends from the slide valve 60 toward the support during traversal of the drum 155. The shaft end 168 has a free motion clearance relative to the drum 155 and the support 14. The ring 167 is received in a cylindrical recess 170 which is fixed to the bracket 154. An adjusting bracket 160 is mounted on a suitable operator's desk, for example on the housing 126 in FIG. 16. The adjusting bracket 160 has a branching fastener 161 which cooperates with the guiding tubes 158, 159. The steel wire 156 is tightened over a drum 162 on an adjusting shaft 164, which is provided with an operating lever 165. The adjusting shaft 164 is rotatably journalled in the adjusting bracket 160 and can be locked relative thereto by means of a lock screw 166.

By actuating and locking the operating lever 165, the set angular value of the housing 61 of the directional control valve T27 can be set to a desired position relative to the vertical line, the direction of which is automatically applied on the slide valve 60 by means of the pendulum 150 during the swinging of the drill boom.

When used in an application of the type shown in FIG. 1, the directional control valve T27 is coupled to adjust either the control cylinder 26 or the control cylinder 34, and when used in an application corresponding to FIG. 16, the valve T27 is coupled to adjust the control cylinder 120. As previously described, the control cylinder associated with the valve T27 is changed in length in such a way that the drilling axis 12 is positioned to form an angle relative to the vertical line, which angle is set and maintained by means of the operating lever 165. The adjusted direction of the drilling axis is thus automatically maintained during the drilling operation.

In the embodiment according to FIGS. 20 and 21, the rock drilling machine 10 is fixed to a support 14 which is prolonged forwards and carries a fixed intermediate drill steel centralizer 172 of suitable conventional type. The drill steel centralizer 172 aligns and stiffens the drill steel. A foot piece 173 rests against the rock 58 by means of one or several spurs and provides a forward centralizer for the drill steel 11. The foot piece 173 is forwardly displaceable by means of a pair of parallel guiding rods 174, which stiffen the drill steel 11. The guiding rods 174 are slidable in the support 14 and are fixed to an abutment 175 at their rear ends. A pressure fluid powered winch 200, for example remote controlled and provided with a gear motor, can be mounted on the support 14 for longitudinal adjustment of the foot piece relative to the support 14. A conventional suction hood, not shown, can be mounted on the foot piece 173 for removal of drill dust. The support 14 is carried by a rotatable shaft 176 on a boom head 178 at the distal end of a foldable boom comprising the boom members 179, 180. The support 14 is angularly adjustable about the shaft 176 relative to the boom head 178 by means of a swing cylinder 181. The boom head 178 is angularly adjustable about a shaft 177 on the boom member 180 by means of a tilt cylinder 182. The boom member 180 is angularly adjustable relative to the boom member 179 by means of a power cylinder 183. The boom member 179 is angularly adjustable about a horizontal shaft 186 on a boom bracket 188 by means of an elevating cylinder 184. The boom bracket 188 is carried by bearings on a supporting device 190 and is swung about a vertical shaft relative to the supporting device by means of a swing cylinder 185. The supporting device 190 forms part of a conventional drill rig 191, not shown.

In order to automatically control the rock drilling machine 10 with respect to the tilt angle about the shaft 177, a pendulum valve arrangement of the type previously described in FIGS. 18, 19 is preferably used. When adjusted for drilling, the pendulum valve arrangement is coupled for feed-back control of the tilt cylinder 182. Adjustment with respect to the rotatable shaft 176 in its turn is ensured by means of the directional control valve R27, FIG. 21, which as to constructional features in all essentials coincides with T27, FIG. 18, and which to begin with is coupled for feed-back control of the swing cylinder 181. By means of the cylindrical surface 153, the valve housing 61 is rotatably journalled in a bridge 192 inside the boom head 178. A steel wire 193 is wound around the drum 155 of the valve housing 61. The steel wire 193 forms part of the angle transmission and leads to a second operating lever, not shown, on the supporting device 190. The second operating lever is similar to the first lever 165, FIG. 19, and is suitably mounted adjacent thereto. A central shaft end 194 extends from the slide valve 60 through the hollow drum 155 into a central bore in the shaft 176. The shaft end 194 is connected to the shaft 176 by means of a cross pin 195 to be non-rotatably locked thereto.

Upon having moved the drill rig 191 to a desired drilling position and upon having levelled the drill rig so that the shaft 189 is vertical, the rock drilling machine 10 is positioned along the desired drilling axis 12 by means of the directional control valves of the cylinders 183, 184, and 185 and by means of the directional control valves T27 and R27 and the respective operating levers 165 associated therewith. A collaring is now carried out in the rock 58 by means of the drill steel 11 which is centered by the foot piece 173. The foot piece rests against the rock by its weight or by winch power. The tilt cylinder 182 and the swing cylinder 181 are then released and disconnected from their directional control valves T27 and R27, respectively, by means of release valves of the type shown in FIG. 1 and denoted by 36; each of the cylinders having its own release valve. The directional control valve T27 is instead coupled for feed-back control of the power cylinder 183 and the directional control valve R27 is coupled for feed-back control of the swing cylinder 185. Then a suitable feed pressure is applied in the power cylinder 184 which seeks to swing the boom members 179, 180 about the horizontal shaft 186. During such swinging, the tilt shaft 177 is moved along the arc 197 which has the horizontal shaft 186 as it centre. Due to the above movements, the released boom head tends to tilt in counter clock-wise direction about the tilt a shaft. The opening of the drill hole 57 or the point of the foot piece 173 defines the centre point relative to which the boom head swings. Subject to this tilting tendency, the pendulum 150 reacts and causes the directional control valve T27 to adjust the length of the cylinder 183 in such a way that the boom member 180 is swung upwards and the pendulum takes back its initial angle. As a consequence thereof, the tilt shaft 177 is forced to follow the straight line 198 so that the rock drilling machine 10 will drill the hole 57 parallel with the line 198 along the set drilling axis 12. During the adjusting procedure of the drilling, the correct actual angle value of the rock drilling machine 10 in space and relative to the rock 58 is transmitted and defined by the rigid rods 174 together with the drill steel 11. When the drilling axis 12 is inclined also about the swing shaft 176 at angle to the plane of the foldable boom 179,180, the feeding force of the cylinder 184 seeks to increase the inclination. This tendency is sensed by the valve R27 through a change in angle which, however, immediately is readjusted to zero by the swing cylinder 185 which is feed-back coupled. The cylinder 185, thus, swings the foldable boom 179, 180 back to the drilling axis 12. Also the inclination sidewards, thus, remains unchanged during drilling. Upon having reached full hole depth, the valves T27 and R27 are connected to the tilt cylinder 182 and the swing cylinder 181, respectively, and the power cylinder 183 is again subordinated to its normal directional control valve. The drill steel is then withdrawn out of the hole by means of the support 14, whereupon the foot piece 173 is moved from the rock 58 via the abutment 175, provided that the foot piece cannot be maneuvered in both directions by means of the steel wires 199 and the winch 200 on the support 14. During feeding of the rock drilling machine 10 and the movement relative thereto of the stationary guiding rods 174, the motor of the winch can be reversely rotated under leakage against the fluid pressure acting in the motor.

If the boom bracket 188 of the foldable boom 179, 180 is turnably adjustable also with respect to a horizontal shaft, the directional control valve T27 in FIG. 18 can instead be actuated by its operating lever 165, FIG. 19, via a series of wire transmissions which pass the boom joints; the wire transmissions being made according to the principle shown in FIG. 16. In doing so, the capability of adjusting the set angle value is maintained for example also when the boom members are horizontal.

Instead of the steel wire transmission, a mechanical angle transmission can alternatively be used which as hydraulic cylinders mutually coupled for parallel displacement. Such a parallel displacement arrangement is described in detail in Swedish patent application No. 7707138-9 filed June 21, 1977 (corresponding to U.S. application Ser. No. 916,063, filed June 16, 1978), FIGS. 12 and 15.

What I claim is:

1. Rock drilling apparatus comprising:

a drill boom, a rock drilling machine equipped with a drill steel and pivotally carried on the drill boom at a fixed distance from and pivotally about a first pivot means transverse to the boom, a boom supporting structure for pivotally supporting the drill boom about a second pivot means parallel with said first pivot means, a pressure fluid driven positioning motor connected to said drill boom for pivoting during drilling said rock drilling machine and drill steel in unison about said first pivot means and about the tip of the drill steel in the hole being drilled so as to transmit to said first pivot means a corrective feeding movement relative to the desired drilling axis of the hole, a pressure fluid driven feeding motor separate from said positioning motor connected to said boom supporting structure for moving said drill boom laterally during drilling so as to transmit a main feeding movement via said first pivot means to said rock drilling machine in the general direction of the desired drilling axis, first sensing means incorporating a first rotary directional control valve element connected to said rock drilling machine for sensing during drilling the actual angular position in space of the rock drilling machine and drill steel relative to said supporting structure, second sensing means incorporating a second rotary directional control valve element cooperating with said first valve element and selectively adjustable relative to said supporting structure to sense a set angular value parallel with the direction of the desired drilling axis, angle transmission means between the rock drilling machine and said supporting structure associated with one of said first and second valve elements, said first and second valve elements forming part of a pressure fluid servo control system connected to control the fluid supply to said positioning motor and having a feedback position wherein said positioning motor adapts said corrective feeding movement to said main feeding movement such that the rock drilling machine is fed and drills the hole closely along the desired drilling axis.

2. An apparatus according to claim 1, in which said second pivot means has a mechanical feed associated therewith on said supporting structure for applying said lateral movement via said second pivot means to the drill boom, and means permitting resilient movement of the second pivot means relative to said mechanical feed longitudinally of said drill boom.

3. An apparatus according to claim 2, wherein the positioning motor comprises a control cylinder which is coupled between the end of the drill boom remote from the rock drilling machine and the boom supporting structure across said second pivot means, a further pressure fluid motor pivotally coupled between the rock drilling machine and the drill boom across said first pivot means therebetween and means for releasing said further pressure fluid motor during drilling so as to allow free pivotal movement between the rock drilling machine and said drill boom.

4. An apparatus according to claim 1, in which said positioning motor is pivotally coupled between the rock drilling machine and the drill boom across said first pivot means therebetween, a further pressure fluid motor pivotally coupled to the drill boom across said second pivot means on said supporting structure, means for releasing said further pressure fluid motor during drilling so as to allow free pivotal movement between the drill boom and the boom supporting structure, and means associated with said drill boom on said supporting structure permitting resilient variation of the longitudinal distance between said first pivot means and said supporting structure.

5. An apparatus according to claim 1, in which the drill boom is extensible providing an outer boom member with said first pivot means thereon and extensibly carried by an inner boom member with said second pivot means thereon, said positioning motor being coupled between said boom members for transmitting said corrective feeding movement to said first pivot means, and said feeding motor pivotally connected between said inner boom member and said boom supporting structure across said second pivot means therebetween.

6. An apparatus according to claim 1, in which the drill boom is a foldable boom comprising pivotally interconnected inner and outer boom members with said first pivot means on said outer boom member and said second pivot means on said inner boom member, said positioning motor being pivotally connected between said boom members for transmitting said corrective feeding movement to said first pivot means, and said feeding motor pivotally connected between said inner boom member and said boom supporting structure across said second pivot means therebetween.

7. Apparatus according to claim 6, in which a third pressure fluid motor is pivotally coupled between the rock drilling machine and the outer boom member across said first pivot means, and means is provided for releasing said third pressure fluid motor during drilling to allow free pivotal movement between the drilling machine and the outer boom member.

8. An apparatus according to claim 1, in which the rock drilling machine is provided with at least one guiding rod for stiffening said drill steel, said guiding rod extending in slidable relation to said rock drilling machine therebetween the rock in parallel but laterally spaced in relation to said drill steel and pivotally relative to the rock.

9. Apparatus according to claim 1, wherein said positioning motor is pivotally connected to said drill boom.

10. Rock drilling apparatus comprising:

a drill boom, a boom support for supporting the drill boom, a rock drilling machine equipped with a drill steel and swingably carried with respect to the drill boom and boom support, a positioning motor connected to the drill boom for positioning the rock drilling machine relative to the drill boom, the positioning motor comprising a control cylinder which is pivotally coupled between the rock drilling machine and the drill boom across a hinge therebetween, means for moving said drill boom laterally during drilling so as to produce a feeding movement of said rock drilling machine, means associated with said drill boom for permitting during drilling said rock drill to move transversely of the desired drilling axis in response to actuation of said positioning motor while the forward end of said drill steel is taking alignment with the hole drilled, a servo control system coupled to the positioning motor for actuating the positioning motor during drilling to govern the transverse position of said rock drill relative to said drilling axis such that the rock drilling machine is fed automatically therealong in consequence of a feeding movement applied by the drill boom, means dependent on the forward end of said drill steel taking alignment with the hole drilled for thereby sensing the actual angular position in space of the rock drilling machine while feeding movement and drilling are going on and for feeding the servo control system, as an actual angular value, an angular value corresponding to the angular position in space of the rock drilling machine while feeding movement and drilling are going on, and means for feeding to the servo control system, as a set angular value, a fixed angular direction value which is parallel with the direction of the drilling axis, and the servo control system including means responsive to said actual and set angular values for continuously governing the positioning motor while feeding movement and drilling are going on such that the positioning motor causes the actual angular value to coincide with the set angular value and thus the rock drilling machine to follow the drilling axis, the boom support having a mechanical feed associated therewith for applying the feeding movement of the drill boom, pivot means between the end of the drill boom remote from the rock drilling machine and the boom support, and means permitting resilient movement of the boom support relative to said mechanical feed longitudinally thereof in response to actuation of said positioning motor.

11. An apparatus according to claim 10, characterized in that a further pressure fluid motor is pivotally coupled between said drill boom and said boom support for positioning said drill boom, and means is provided for releasing said further pressure fluid motor during drilling so as to allow free pivotal movement between said drill boom and said support.

* * * * *